US005273591A

United States Patent [19]

Perkins

[11] Patent Number: 5,273,591

[45] Date of Patent: Dec. 28, 1993

[54] METHOD FOR CLEANING TANKER CARGO TANKS

[75] Inventor: Thomas K. Perkins, Dallas, Tex.

[73] Assignee: Atlantic Richfield Company, Los Angeles, Calif.

[21] Appl. No.: 868,156

[22] Filed: Apr. 14, 1992

[51] Int. Cl.[5] ..... B08B 9/08

[52] U.S. Cl. ..... 134/22.19; 134/22.1; 134/22.18; 134/26; 134/36

[58] Field of Search ..... 134/22.1, 22.19, 36, 134/22.18, 26

[56] References Cited

U.S. PATENT DOCUMENTS 3,436,263 4/1969 Strenkert et al. ..... 134/22.19
4,770,711 9/1988 Deal, III et al. ..... 134/18

FOREIGN PATENT DOCUMENTS 1062122 12/1983 U.S.S.R. .
0807609 8/1957 United Kingdom .

*Primary Examiner*—Asok Pal
*Assistant Examiner*—P. Achutamurthy
*Attorney, Agent, or Firm*—Michael E. Martin

[57] ABSTRACT

Deposits are removed from cargo tanks of marine crude oil tankers and the like by introducing into the tanks a solvent for the deposits which are formed on the interior surfaces of the tanks, including those surfaces which cannot be reached by crude oil washing machines and the like. The solvent is caused to contact all of the interior surfaces of the tanks by pumping ballast water sequentially into and out of the tanks to cause the solvent to rise and fall in each of the tanks. The method may be carried out during return trips of tankers from the point of discharge of cargo to the point of loading new cargo.

7 Claims, 1 Drawing Sheet

METHOD FOR CLEANING TANKER CARGO TANKS

BACKGROUND OF THE INVENTION

1. Field of the Invention

The present invention pertains to a method for cleaning the cargo tanks of a marine crude oil tanker using a solvent to remove deposits such as waxes and asphaltenes which adhere to the cargo tank walls and floor.

2. Background

In the transportation of crude oil by marine tankers and the like, deposits of substances such as waxes and asphaltenes accumulate on the cargo tank walls and in the tank bottoms, in particular. These deposits require periodic removal by washing the tank surfaces with crude oil or hot water using apparatus which may be inserted into the tank from the tank top or deck of the ship. These devices are typically characterized by articulated jet nozzles which wash the tank walls with crude oil, hot water or other materials.

However, the interiors of the cargo tanks of marine tankers, in particular, are not simple cylindrical or four-walled chambers. The ship structural members such as deck girders, stringers, transverse frames, and other reinforcing members extend into the tank spaces and are coated with the same substances as the tank side walls and tank bottoms. Conventional tank cleaning practices do not sufficiently clean the surfaces of these structural members to the degree that is desired or necessary. During ship layup the tank interiors must be manually cleaned by workmen who are required to go into the tank with suitable cleaning equipment. If the tank surfaces have been neglected for too long a time, sand blasting may be required for a thorough cleaning. Both of these latter mentioned operations are expensive and time consuming.

Accordingly, there has been a need to develop a more convenient way of thoroughly cleaning the cargo tanks of marine tankers which does not interrupt operation of the ship and may, for example, be carried out during return transit of the ship to pick up a new cargo. The present invention is directed to a solution for the aforementioned problem in an efficient and uncomplicated manner.

SUMMARY OF THE INVENTION

The present invention provides an improved method for cleaning the interiors of cargo tanks used for storing crude oil, particularly those tanks which are characterized as compartments of a marine crude oil tanker.

In accordance with one important aspect of the present invention, an improved method for cleaning the cargo tanks of a marine tanker is provided using a solvent of which a limited quantity is placed in one or more of the cargo tanks and caused to contact all of the tank surfaces. In a preferred method a more dense liquid, such as water, is pumped into the tank under the solvent to cause the solvent to rise in the tank to the tank top and then returned to the tank bottom by pumping water out of the tank. Plural cargo tanks of a tanker may be sequentially cleaned in a timely and efficient manner through a series of transfers of solvent and water between tanks.

One advantage of the present invention is realized in that minimal exposure of operating personnel to hazards of tank cleaning operations is provided.

In accordance with another important aspect of the present invention, an improved tanker cargo tank cleaning method is provided which is operable to clean all interior surfaces of a cargo tank efficiently utilizing conventional shipboard equipment by exposing solvents such as refined hydrocarbon liquids to all interior surfaces of the cargo tanks. A layer of solvent is traversed through the tank with ballast water and both ballast water and solvent are transferred between cargo tanks in a sequential manner to effect sufficient exposure of the solvent to each tank to remove deposits accumulated on the interior surfaces thereof. The cleaning process may by carried out while the ship is in transit and the used solvent may be further used by refining or by direct use as a combustion fuel or the like.

Those skilled in the art will recognize the above-mentioned features and advantages of the present invention together with other superior aspects upon reading the detailed description which follows in conjunction with the drawing.

DESCRIPTION OF A PREFERRED EMBODIMENT

Figure 1:
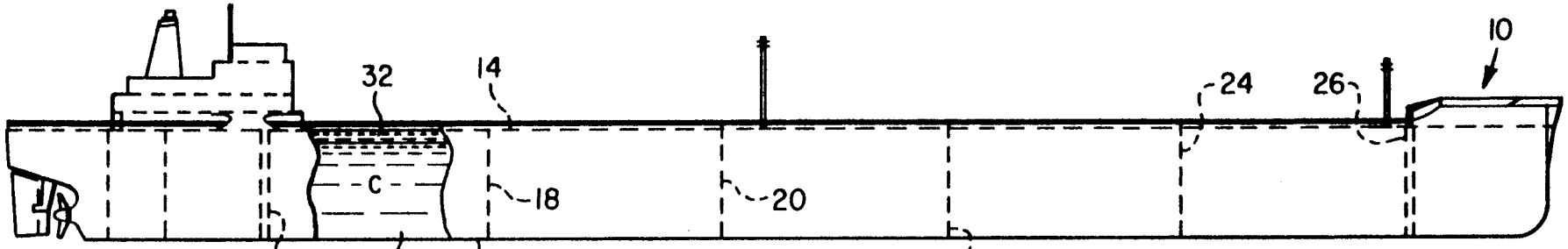
FIG. 1 is a side elevation of a marine tanker having multiple cargo tanks which may be cleaned in accordance with the method of the present invention.
Figure 2:
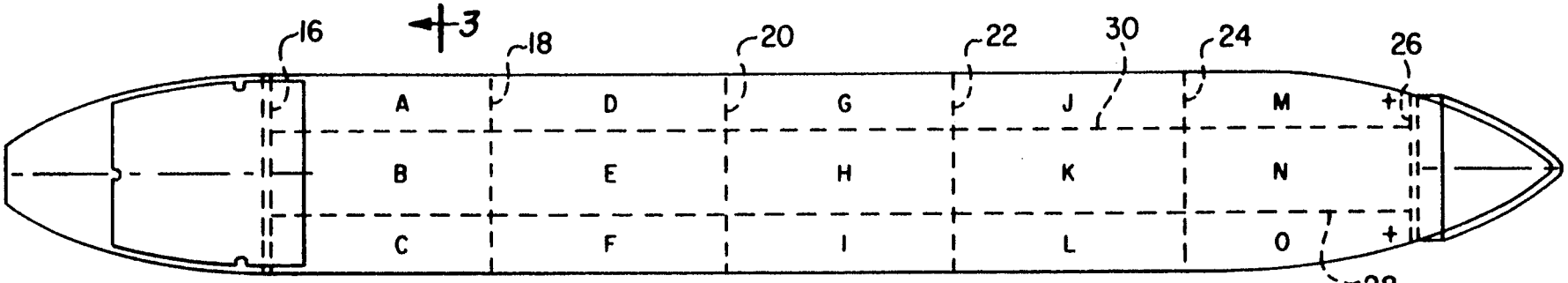
FIG. 2 is a plan view of the tanker illustrated in FIG. 1 showing identification of the cargo tanks with the letters A through O.

The drawing figures are simplified illustrations of a marine crude oil carrier or tanker, generally designated by the number 10. The tanker 10 is of a conventional type having a plurality of cargo tanks formed three abreast and identified with the letters A through O. Although the exemplary tanker 10 is shown with a total of 15 storage tanks A through O, those skilled in the art will recognize that any number of tanks may be cleaned in accordance with the method of the present invention. The tanks A through O are delimited by the ship bottom 12, a deck 14, plural transverse bulkheads 16, 18, 20, 22, 24, and 26 and longitudinal bulkheads 28 and 30. Not shown in the diagrams of FIGS. 1 and 2 are substantial numbers of structural members making up the ship 10 including transverse frame members, deck girders, stringers and other structural support and reinforcing members comprising the frame of the ship and which have surfaces exposed to the respective tanks A through O. It is these latter mentioned members, in particular, on which an accumulation of paraffin waxes, asphaltenes and other deposits accumulate from the repeated transport of loads of crude oil and the like by the tanker 10.

Certain water-immiscible solvents are effective in removing the aforementioned deposits from vertical, horizontal and other surfaces exposed to the interiors of the tanks A through O. Solvents such as motor gasoline, turbine fuel and certain condensates reclaimed from the production of crude oil and the like are capable of removing deposits such as waxes and asphaltenes at a rate of up to about 0.16 inches per hour with reference to the thickness of the deposit on a metal surface. Such solvents will slowly dissolve the deposits when exposed to the deposits in a stagnant condition or when moving slowly past the deposit/solvent interface. In most instances, the thickness of the aforementioned deposits on the tank surfaces are believed to be relatively thin (approximately 0.125 inches thickness) after cleaning with the aforementioned crude oil or hot water washing machines. On the other hand, the deposits may be considerably thicker at or near the tank bottom or on the surfaces of structural members in the tanks which cannot be reached by the wash stream of the crude oil or hot water washing machines. However, by contacting a solvent of the type mentioned above, floating on a more dense liquid such as water, for example, with the entire interior surface of the cargo tanks the amount of time required to clean the cargo tanks is minimized. Moreover, if the solvent is reused by sequentially transferring the solvent to a plurality of tanks the amount of solvent required is also minimized. Solvents other than those mentioned above, and which have greater or lesser deposit removal rates, may also be used.

The drawing figures illustrate an arrangement of cargo tanks A through O which is a simplified diagram and presupposes that the 15 tanks shown are of approximately the same capacity. Although actual crude oil carrier ships may have cargo tanks of many different sizes, the example described herein will illustrate the invention. The pumping rates and volume may be adjusted for tank capacity and the thickness of deposits on the tank interior surfaces. Conventional pumping equipment, manifolds and piping, normally provided on tankers, for transferring liquids into and out of, as well as between the cargo tanks is not shown in the drawing figures in the interest of conciseness. Such piping normally includes inlet and outlet openings arranged generally at the bottoms of the cargo tanks.

Assume that the tanker 10 has cargo tanks A through O which are of uniform size, have a capacity of approximately 50,000 barrels of liquid and a depth of approximately 60 feet. The example given below would require approximately 17,000 barrels (714,000 gallons) of solvent such as motor gasoline or JP4 turbine fuel. Exposure times may be varied for solvents such as "light cycle" oil, light crude oil and various condensates which may also be used as solvents. The example given below will provide for "cleaning" or removal of approximately 0.125 inches of deposit from all vertical surfaces and the removal of two inches of deposit from the bottom five feet of each tank. The method of cleaning the cargo tanks A through O may be accomplished in approximately 120 hours (5 days).

Figure 3:
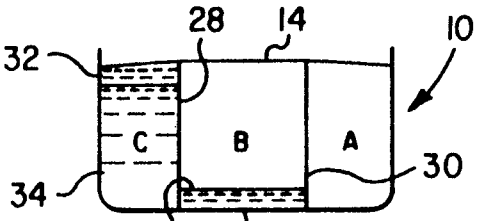
FIG. 3 is a section view taken along line 3—3 of FIG. 2.

An exemplary cleaning method is as follows:

FIG. 3 illustrates an intermediate condition in the below described method wherein tank A has already been cleaned, tank B has solvent 32 therein and tank C is filled with solvent and ballast water 34. This is the condition that would exist after 25 hours elapsed time according to Table 1. However, initially, approximately five feet of solvent 32 is pumped into the bottom of each of tanks A, B, C, and D. Ballast water 34 is then pumped into tank A to bring the top of the solvent layer to the top of the tank in about six hours. This would provide a rate of rise of about 9.1 feet per hour. The aforementioned solvents, such as motor gasoline or JP4 turbine fuel, which have a deposit removal rate for paraffin waxes and asphaltene substances of about 0.16 inches per hour will remove at least 0.0879 inches of solid deposit since each part of the vertical tank surfaces will be contacted by the solvent for at least 5.0 feet divided by 9.1 feet per hour, or 0.549 hours. Moreover, 0.549 hours multiplied by 0.16 inches per hour equals 0.0879 inches of solid deposit dissolved into the solvent. When each tank is filled to capacity, such as illustrated for tank C in FIGS. 1 and 3, with the top five feet of liquid comprising solvent, the liquid in the tank in question is held stagnant for one hour to assure that the top of the tank is contacted for that period of time to remove at least 0.16 inches of deposit.

Water is then pumped from tank A, for example, into tank B at the same rate as previously described thus removing, an additional 0.0879 inches of deposit from all vertical surfaces of tank A as the solvent is lowered through the tank. An initial 0.0879 inches of deposit is removed from all vertical surfaces of tank B as the solvent in that tank traverses up through the tank above the ballast water to the tank top delimited by the deck 14.

When all of the ballast water has been removed from tank A, and during the one hour while residence of the ballast water is permitted in tank B, the solvent in tank A may be transferred to tank E at a convenient rate.

Water and solvent are then sequentially transferred among tanks A through O until all tanks have been cleaned in accordance with the schedule indicated in Table 1 hereinbelow. Near the end of the sequence, solvent is accumulated in tank A so that it will also be contacted by solvent for at least 12 hours, thus resulting in the removal of about two inches of solid deposits from the bottom five feet of tank A (12 hours$\times$0.16 inches per hour=0.92 inches).

Although the sequence of pumping operations for the example given in Table 1 below could result in the cleaning of a tanker having a storage capacity of 750,000 barrels of crude oil in about five days (the time for a return voyage of a crude oil tanker from Southern California to Valdez, Ak., for example), parallel pumping operations could be conducted to speed up the cleaning process. Moreover, if thicker deposits were expected on the tank interior surfaces, thicker solvent layers or slower pump rates could be provided to permit longer exposure time of the solvents to the tank interior surfaces.

A sequence of pumping operations for cleaning the tanks A through O of tanker 10, having the capacities stated above, is shown in Table 1.

TABLE 1

| ELAPSED TIME HOURS | PUMPING ACTIVITY RE TANKS A THROUGH O |
|---|---|
| 0–5 | hold 5 ft. of solvent in each A–D |
| 5–11 | pump water into A at 9.1 ft/hr. |
| 11–12 | no pumping |
| 12–18 | pump ballast from A into B |
| 18–19 | pump solvent from A into E |
| 19–25 | pump ballast from B into C |
| 25–26 | pump solvent from B into F |
| 26–32 | pump ballast from C into D |
| 32–33 | pump solvent from C into G |
| 33–39 | pump ballast from D into E |
| 39–40 | pump solvent from D into H |
| 40–46 | pump ballast from E into F |
| 46–47 | pump solvent from E into I |
| 47–53 | pump ballast from F into G |
| 53–54 | pump solvent from F into J |
| 54–60 | pump ballast from G into H |
| 60–61 | pump solvent from G into K |
| 61–67 | pump ballast from H into I |
| 67–68 | pump solvent from H into L |
| 68–74 | pump ballast from I into J |
| 74–75 | pump solvent from I into M |
| 75–81 | pump ballast from J into K |
| 81–82 | pump solvent from J into N |
| 82–88 | pump ballast from K into L |
| 88–89 | pump solvent from K into O |

TABLE 1-continued

| ELAPSED TIME HOURS | PUMPING ACTIVITY RE TANKS A THROUGH O |
|---|---|
| 89-95 | pump ballast from L into M |
| 95-96 | pump solvent from L into A |
| 96-102 | pump ballast from M into N |
| 102-103 | pump solvent from M into A |
| 103-109 | pump ballast from N into O |
| 109-110 | pump solvent from N into A |
| 110-116 | pump ballast from O into B |
| 116-117 | pump solvent from O into A |

When the tanker 10 reaches its destination, of course, the solvent residing in tank A may be off-loaded together with the ballast water residing in tank B. The final destination of solvent and ballast water may be to selected ones of the other tanks which have been emptied as the sequence progresses.

The method of the present invention provides a unique, low cost procedure for cleaning the cargo tanks of marine tankers and other cargo tanks used to carry crude oil or liquids which are likely to leave substantial deposits on the tank surfaces, which deposits must be removed to prevent contamination with other liquids which may be carried by the tanks and to prevent loss of cargo space. More thorough cleaning is obtained than is likely to be possible with washing apparatus of conventional configuration or even that which must be carried out during periodic ship layup. Contact of the solvent with out-of-the way structural members which are exposed to the interior spaces of the cargo tanks, such as longitudinal deck girders, stringers and transverse frame members and other supporting structure which support and transmit longitudinal and transverse loads and resist hydrostatic pressure in a marine tanker, is particularly advantageous.

Although a preferred embodiment of a method in accordance with the present invention has been described herein, those skilled in the art will recognize that various substitutions and modifications may be made without departing from the scope and spirit of the invention as recited in the appended claims.

What is claimed is:

1. A method for removing deposits comprising waxes and asphaltenes from the interior surfaces of plural cargo tanks of a crude oil tanker, comprising the steps of:

providing a quantity of solvent for said deposits in at least one of said cargo tanks to a depth so as to at least cover the bottom of said one cargo tank; and traversing said quantity of solvent through said one cargo tank to contact said solvent with interior surfaces of said one cargo tank by introducing a liquid more dense than and immiscible with said solvent and comprising water into said one cargo tank.

2. The method set forth in claim 1 including the steps of:

sequentially transferring said solvent and said liquid comprising water into additional ones of said cargo tanks and causing said solvent to traverse the interior surfaces of said additional ones of said cargo tanks by said transfer of said liquid comprising water to clean the interior surfaces of said additional ones of said cargo tanks, respectively.

3. The method set forth in claim 1, including the step of:

controlling the rate of flow of said liquid comprising water into and out of said cargo tanks to provide contact of said solvent with said interior surfaces to remove deposits thereon at a rate which will substantially clean said interior surfaces of said deposits during at least a first and second contacting of said solvent with said deposits.

4. The method set forth in claim 1 wherein:

the step of providing said solvent includes pumping solvent into a plurality of said cargo tanks followed by pumping said liquid comprising water into said one cargo tank and then pumping said liquid comprising water out of said one cargo tank and into another of said cargo tanks to cause solvent in said another cargo tank to traverse the interior surfaces of said another cargo tank.

5. The method set forth in claim 4 including the step of:

pumping solvent from said one cargo tank to still another of said cargo tanks followed by pumping said liquid comprising water into said still another of said cargo tanks to cause said solvent to traverse the interior surfaces of said still another of said cargo tanks.

6. A method for removing deposits from the interior surfaces of cargo tanks of a crude oil tanker comprising the steps of:

providing a quantity of solvent and pumping said solvent into a first cargo tank to a predetermined depth in said first cargo tank;

pumping ballast water into said first cargo tank to cause said solvent to rise within said first cargo tank to contact interior surfaces of said first cargo tank to dissolve crude oil deposits on said interior surfaces;

pumping said ballast water out of said first cargo tank into a second cargo tank containing solvent to cause said solvent to rise in said second cargo tank to contact the interior surfaces of said second cargo tank to dissolve crude oil deposits thereon;

pumping solvent from said first cargo tank to another of said cargo tanks not previously containing solvent; and pumping ballast water out of said second cargo tank into a third cargo tank containing solvent for causing said solvent in said third cargo tank to rise within said third cargo tank to contact the interior surfaces thereof and to dissolve crude oil deposits on said interior surfaces of said third cargo tank.

7. The method set forth in claim 6 further including the steps of:

sequentially pumping solvent from cargo tanks initially containing solvent to further cargo tanks and then sequentially pumping ballast water into all of said cargo tanks containing said solvent to cause said solvent to traverse the interior surfaces of said cargo tanks to effect cleaning of said interior surfaces of said cargo tanks, respectively.

* * * * *